US011781360B2

(12) United States Patent
Terenzi et al.

(10) Patent No.: US 11,781,360 B2
(45) Date of Patent: Oct. 10, 2023

(54) HINGE DEVICE WITH PROGRAMMABLE BEHAVIOR

(71) Applicant: C.M.I. CERNIERE MECCANICHE INDUSTRIALI S.R.L., Valsamoggia (IT)

(72) Inventors: Emanuele Terenzi, Rieti (IT); Federico Pizzi, Zola Predosa (IT)

(73) Assignee: C.M.I. Cerniere Meccaniche Industriali S.R.L.

( * ) Notice: Subject to any disclaimer, the term of this patent is extended or adjusted under 35 U.S.C. 154(b) by 0 days.

(21) Appl. No.: 17/798,776

(22) PCT Filed: Feb. 14, 2021

(86) PCT No.: PCT/EP2021/053572
§ 371 (c)(1),
(2) Date: Aug. 10, 2022

(87) PCT Pub. No.: WO2021/165166
PCT Pub. Date: Aug. 26, 2021

(65) Prior Publication Data

US 2023/0107073 A1 Apr. 6, 2023

(30) Foreign Application Priority Data

Feb. 17, 2020 (IT) ..... 102020000003140

(51) Int. Cl.
*E05F 1/12* (2006.01)

(52) U.S. Cl.
CPC ..... *E05F 1/1253* (2013.01); *E05Y 2900/30* (2013.01)

(58) Field of Classification Search
CPC ..... E05F 1/1246; E05F 1/1253; E05F 1/1261; E05F 1/1269; E05F 1/1276; E05F 1/1292
(Continued)

(56) References Cited

U.S. PATENT DOCUMENTS 2,777,157 A 1/1957 Burke
8,561,259 B2 * 10/2013 Liao ..... E05F 5/006 16/68

(Continued)

FOREIGN PATENT DOCUMENTS

DE 10 2011 081 917 A1 2/2013
EP 3 043 014 A1 7/2016

(Continued)

OTHER PUBLICATIONS

Bibliographic Data including English Abstract, DE102011081917A1, DepatisNet, 2 pages, 2013.

(Continued)

*Primary Examiner* — Jeffrey O'Brien
(74) *Attorney, Agent, or Firm* — Ware, Fressola, Maguire & Barber LLP

(57) ABSTRACT

A hinge device (1) comprises a first member (3) and a second member (5) hinged by a hinge pivot pin (7) where the second member (5) is connected to one end of the transmission member (15). The box-shaped body (9) is equipped with at least one elongated guide (17) parallel to an operative direction (A) and along which at least one constraint element (19) fixed to a distal end (14) of the transmission member (15) slides. One between transmission member (15) and body (9) is equipped with a first elongated slot (23) and the other (9, 15) is equipped with a first mobile element (25) slidingly engaged in the first elongated slot (23); one between the portion (8) and proximal end (16) of the transmission member (15) carries a second slot (31) and the other (16, 8) carries a second mobile element (33) slidingly engaged in the second slot (31).

11 Claims, 14 Drawing Sheets

(58) Field of Classification Search
USPC ..... 16/286, 289, 290
See application file for complete search history.

(56) References Cited

U.S. PATENT DOCUMENTS

| | | | | |
|---|---|---|---|---|
| 8,707,519 | B2 * | 4/2014 | Elkasevic | E05F 3/108 16/286 |
| 8,806,718 | B2 * | 8/2014 | Elkasevic | E05F 1/1261 16/286 |
| 9,080,365 | B2 * | 7/2015 | Collene | E05F 5/02 |
| 9,121,211 | B1 * | 9/2015 | White | E05F 5/02 |
| 10,145,157 | B2 * | 12/2018 | White | F24C 15/023 |
| 10,633,904 | B2 * | 4/2020 | Elkasevic | F24C 15/023 |
| 10,890,334 | B2 * | 1/2021 | White | E05D 7/00 |
| 11,187,021 | B2 * | 11/2021 | Gherardi | E05F 1/1261 |
| 11,268,313 | B2 * | 3/2022 | Terenzi | E05D 3/14 |
| 11,480,341 | B2 * | 10/2022 | Meurer | E05F 15/622 |
| 2003/0172920 | A1 | 9/2003 | Gronback | |
| 2013/0300273 | A1 * | 11/2013 | Elkasevic | E05F 5/08 16/327 |
| 2013/0312220 | A1 * | 11/2013 | Elkasevic | E05F 5/02 16/327 |
| 2022/0034140 | A1 * | 2/2022 | Terenzi | E05F 1/1276 |
| 2022/0186537 | A1 * | 6/2022 | Vanini | E05D 7/06 |

FOREIGN PATENT DOCUMENTS

| | | | |
|---|---|---|---|
| KR | 2018 0112955 | A | 10/2018 |
| WO | 2020/025321 | A1 | 2/2020 |

OTHER PUBLICATIONS

International Search Report (ISR) and Written Opinion of the International Searching Authority, International Application No. PCT/EP2021/053572, dated May 10, 2021, 13 pages.

* cited by examiner 37
13
36
19
6
15
14
14
17
9
23
25
31
7
4
16
33
5

9
6
11
12

37
6
11
12
9

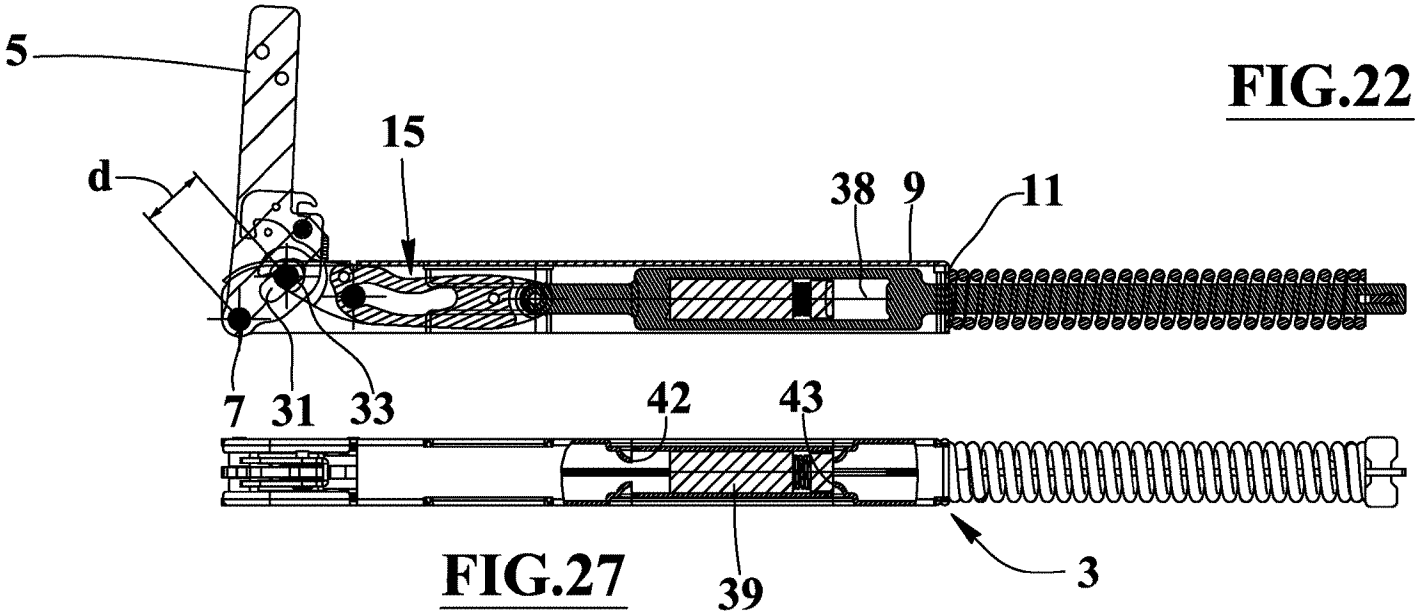
FIG.22
FIG.27
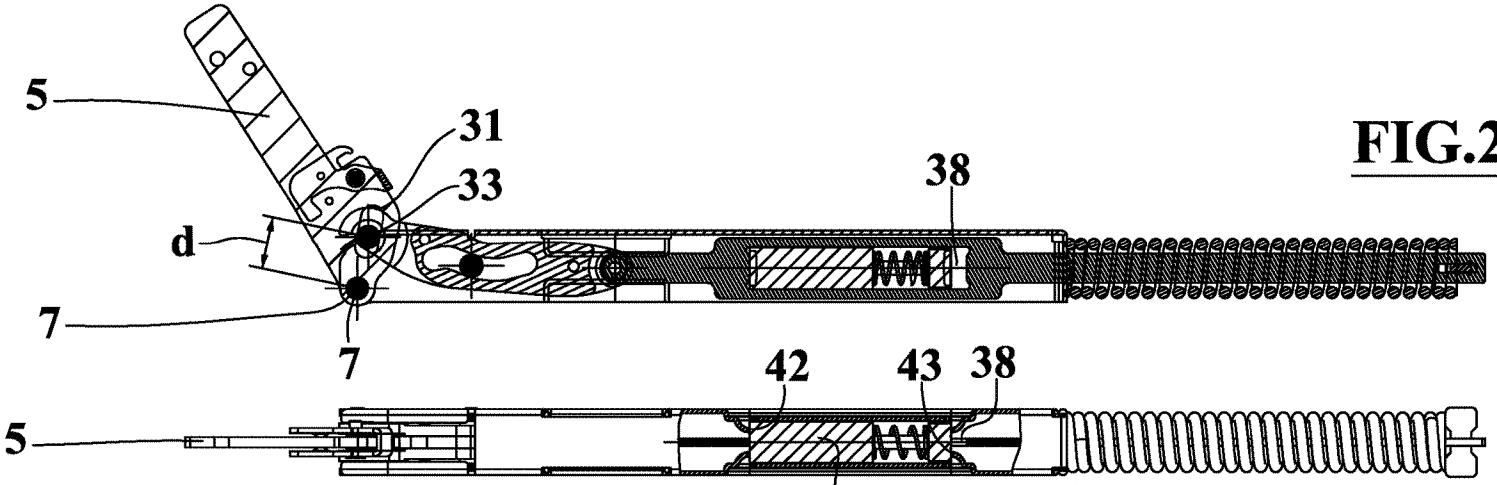
FIG.23
FIG.28

HINGE DEVICE WITH PROGRAMMABLE BEHAVIOR

TECHNICAL FIELD

The present invention relates to the technical field concerning hinges for appliances and furnishings for domestic, commercial and industrial use and refers to a hinge device with programmable behavior suitable, particularly but not exclusively, for shutters or doors with a horizontal rotation axis.

BACKGROUND ART

There are known hinges which are capable of providing variable static behavior depending on the opening angle of the hinge itself, for example to increase the closing force to compress gaskets or to provide intermediate metastable positions between closure and complete opening.

There are also known hinges capable of providing variable dynamic behavior according to the opening angle of the hinge itself, for example to slow down any excessive rotation speeds or to provide a "soft" closing rotation.

A disadvantage of these known hinges is that they are often complex and/or bulky and expensive.

Another disadvantage of said known hinges consists in the fact that they can be assigned and made to provide different behaviors with narrow limitations.

Another disadvantage of these known hinges consists in the fact that they often base their operation on dynamic sliding friction and are therefore subject to changes in behavior with the passage of time, with use and with changes in environmental conditions.

A further disadvantage of the known hinges in object consists in the fact that they can be noisy and unpleasant sounding and/or have a not very fluid operation or be subject to jamming.

DISCLOSURE OF THE INVENTION

An object of the present invention is to propose a hinge device with relatively simple programmable behavior and of sufficiently reduced dimensions to allow its assembly even in confined spaces such as, for example, those of the doors of ovens for domestic use.

Another purpose is to propose a device whose behavior can be programmed differently by means of a simple modification of a few parts.

A further purpose is to propose a hinge whose operation is mainly based on the mechanical transmission of forces and possibly also on viscous friction phenomena and without parts assigned for sliding mechanical friction.

Another purpose is to propose a device with silent and fluid operation.

The patent application DE 10 2011 081917 A1 discloses a hinge device according to the preamble of the independent device claim of the present application.

BRIEF DESCRIPTION OF DRAWINGS

The characteristics of the invention are highlighted below with particular reference to the accompanying drawings in which:

FIG. 6 is also enlarged;

FIGS. 20 and 21 are also enlarged;

FIGS. 22-26 show the sectioned hinge of FIG. 18 in progressive conditions from closing to extreme opening;

FIGS. 27-31 show front views and in which a portion of an element has been removed to highlight underlying parts of the hinges of FIGS. 22-26 respectively;

DETAILED DESCRIPTION

Figure 2:
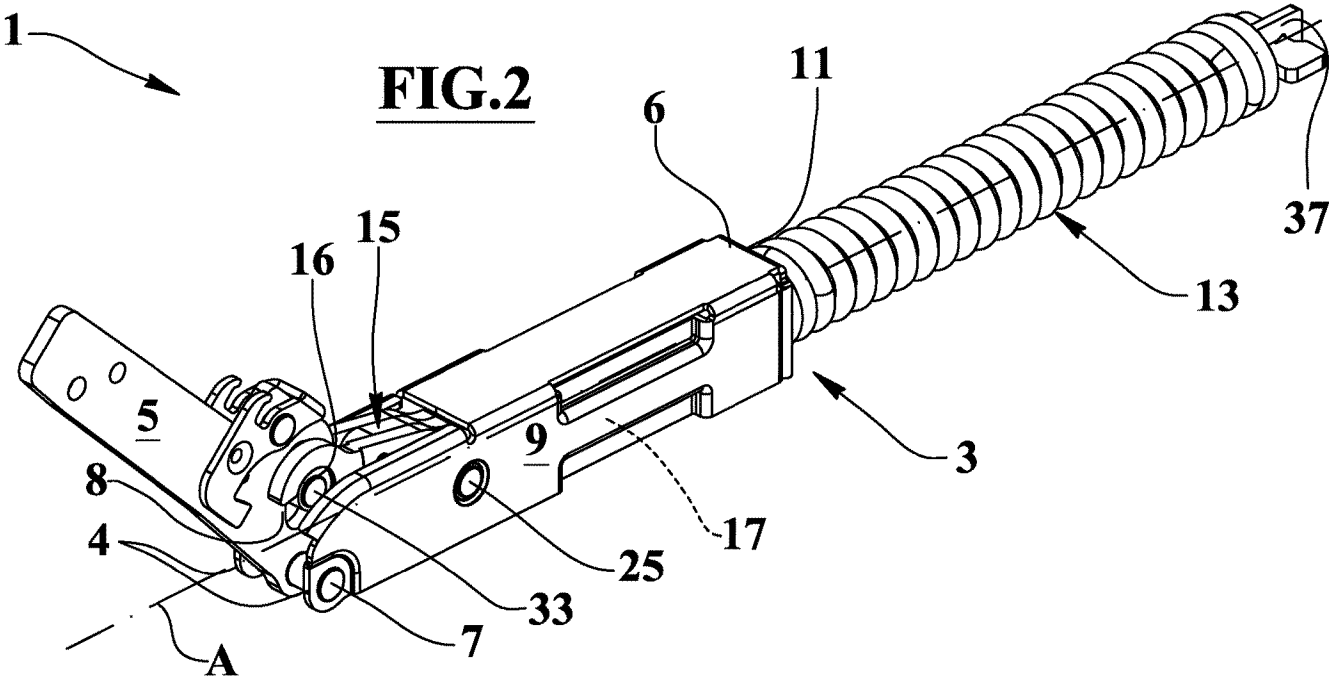
FIGS. 1 and 2 show axonometric views, from respective and opposite points of view, of a first embodiment of a hinge device with programmable behavior, object of the present invention, shown in a partially open condition.
Figure 1:
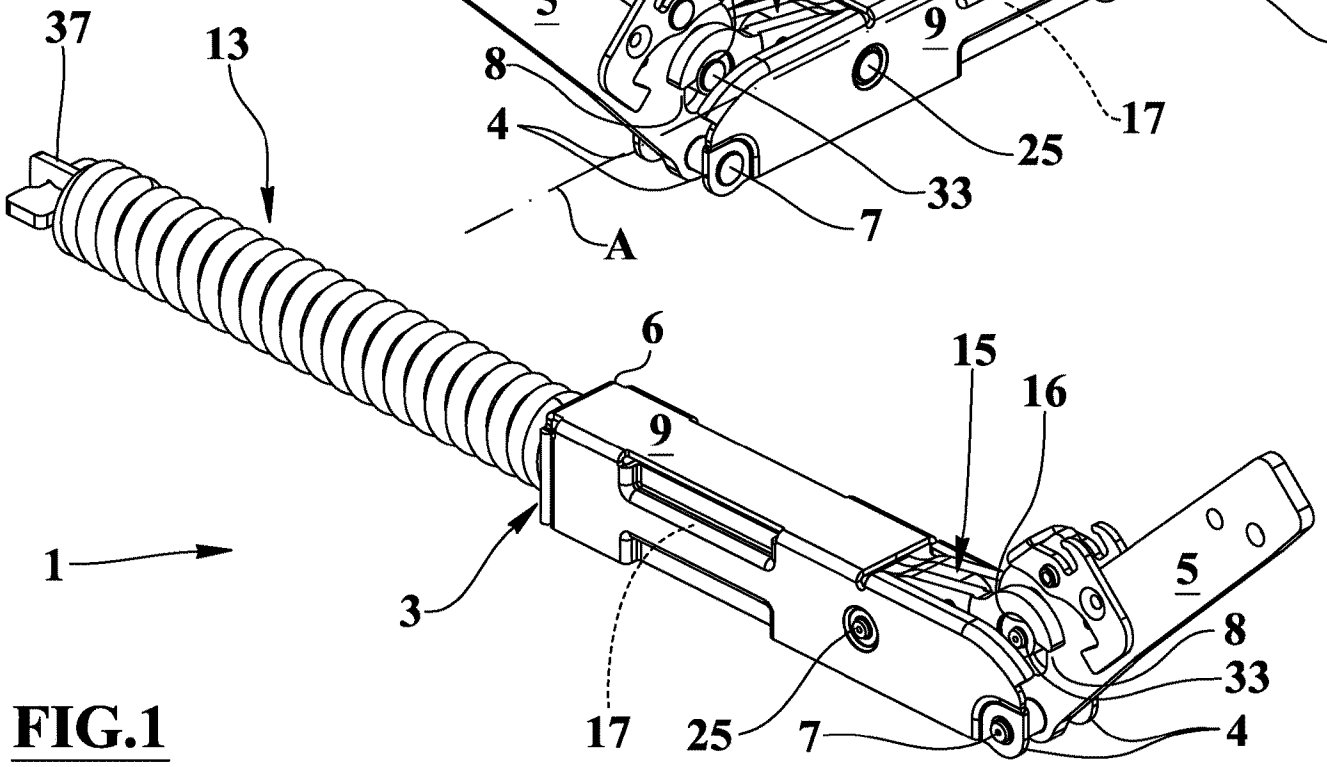
Figure 3:
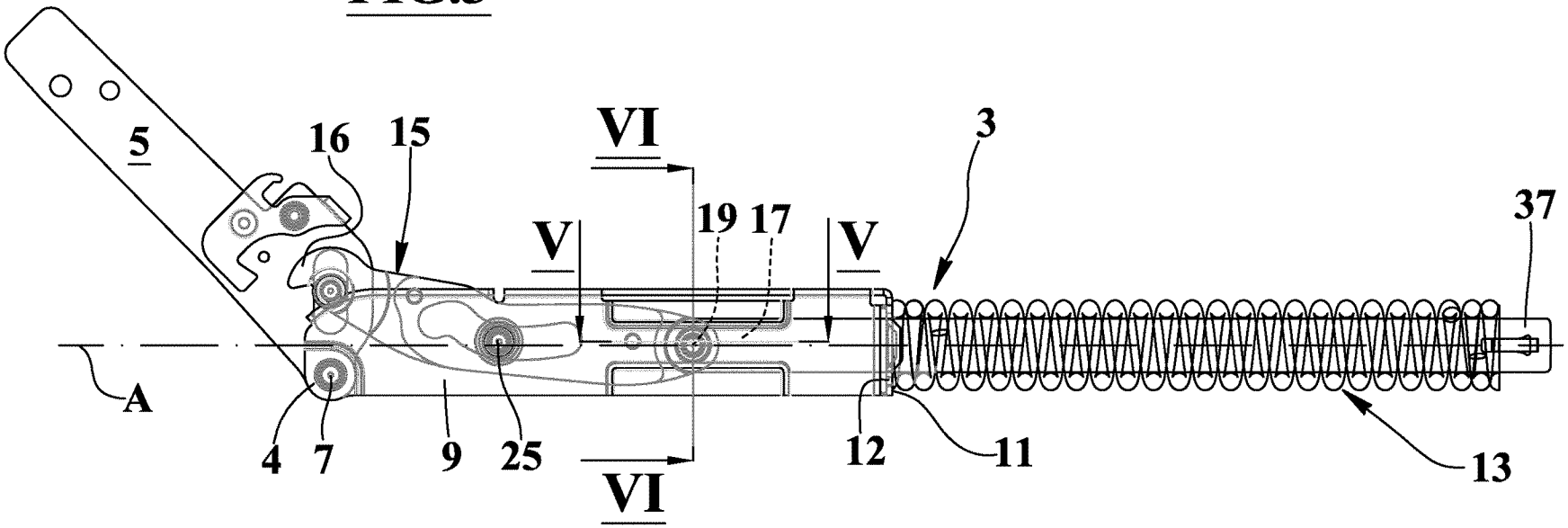
FIGS. 3 and 4 show respectively side and front views of the device of FIG. 1.
Figure 4:
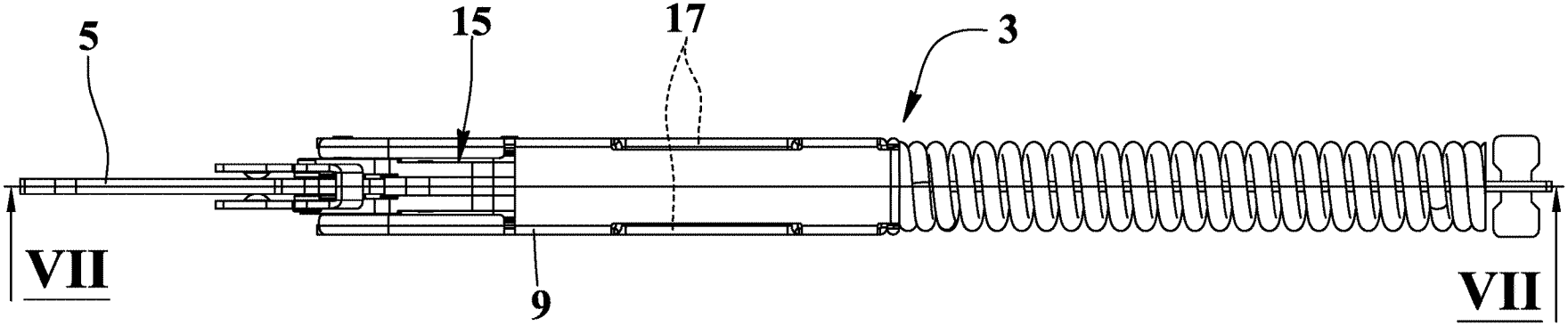

With reference to FIGS. 1-14, numeral 1 indicates the hinge device with programmable behavior comprising a first member 3 and a second member 5 mutually rotatably connected by means of a hinge pivot pin 7.

It should be noted that in the following the terms "proximal" and "distal" associated with the name of two elements will be used in reference to their position with respect to the hinge pivot pin 7, for example the end of an elongated element closest to the hinge pivot pin will be named as the proximal end of the elongated element while the opposite and more distant end will be referred to as the distal end of the elongated element.

One of these first 3 and second 5 members is assigned to be fixed to a structure or frame of an appliance and the other to be fixed to a door or shutter for the rotation of the latter between closed and totally open conditions of the appliance.

For example, and referring to the door of a domestic oven, the first member can be fixed in the oven door while the second member can be removably fixed to the oven body.

The first member 3 comprises an elongated and approximately prismatic box-like body 9 with three longitudinal sides and a distal end wall, for example made of sheared, punched and folded metal sheet. Two longitudinal walls of the body are parallel and facing and joined by the third longitudinal wall forming a sort of element with an open "C" section in correspondence of a longitudinal side and a proximal terminal side.

The opposite proximal 4 and distal 6 ends of the body 9 respectively carry a seat for the hinge pivot pin 7 and a connection or matching member 11, housed in said distal end face, for a resilient element 13.

Such resilient element 13 is connected to a distal end 14 of a transmission member 15 at least partially contained in the box-like body 9 and movable with respect to the latter 9. This connection between the resilient element 13 and the transmission member 15 is assigned to transmit to the latter 15 the elastic force of the resilient element 13 where this force acts along a respective operative direction A and in the opposite direction to the hinge pivot pin 7, or in the distal direction. An area or portion 8 of the second member 5, located at a predetermined distance from a hinge pivot pin 7, is connected to the proximal end 16, opposite the resilient element 13, of said transmission member 15.

In this way, the elastic force of the resilient element 13 is transmitted from the transmission member 15 to the second member 5 in an eccentric area so as to subject the second member 5 to a closing elastic torque, i.e. aimed at carrying the first and second members of the hinge to form an interposed angle of minimum value.

Said box-like body 9 is provided with at least an elongated guide 17 whose geometric axis is parallel to the operative direction A and along which at least one constraint element 19 slides fixed to said distal end 14 of the transmission member 15.

Figure 6:
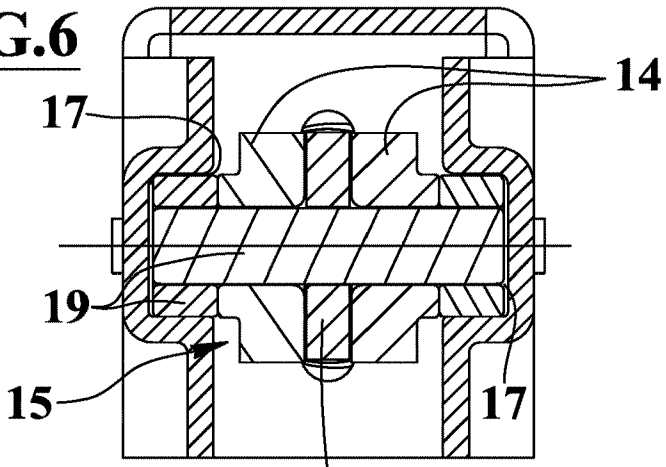
FIGS. 6 and 7 show sectional views along the respective planes VI-VI of FIG. 3 and VII-VII of FIG. 4, where
Figure 7:
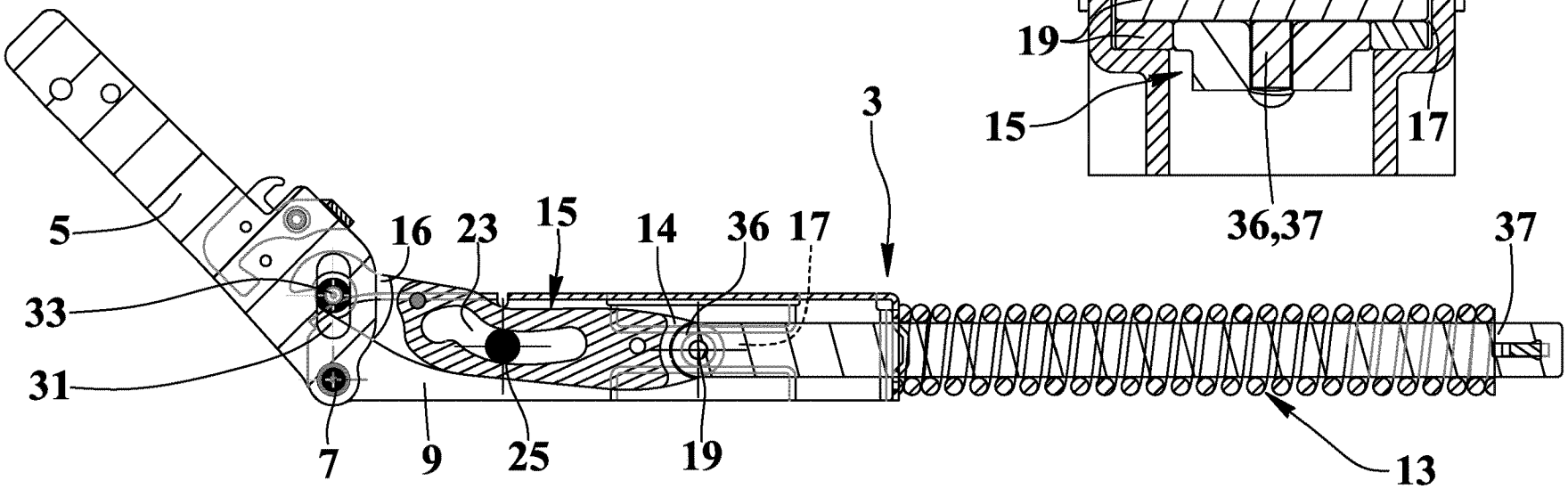
Figure 5:
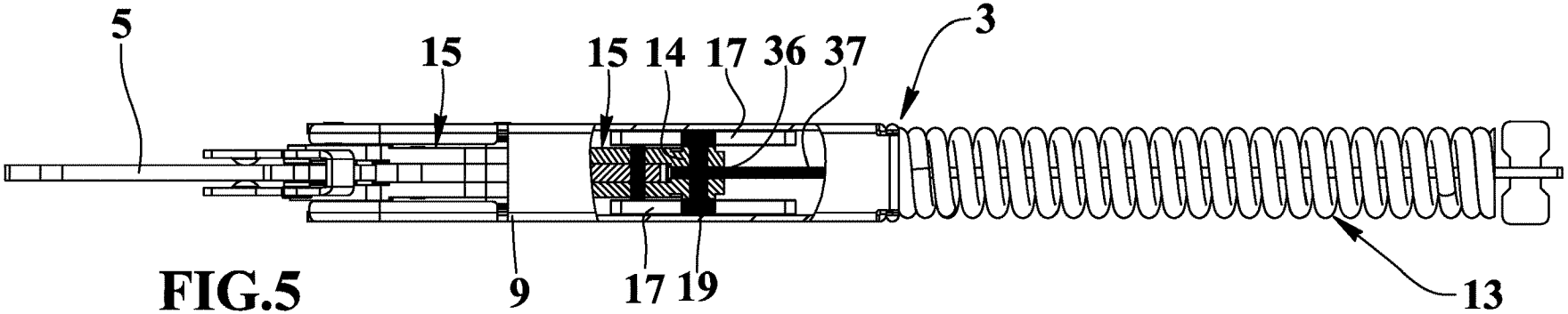
FIG. 5 shows a front view of the device of FIG. 1 in which some parts have been removed to better highlight others, especially view V-V of FIG. 3.
Figure 8:
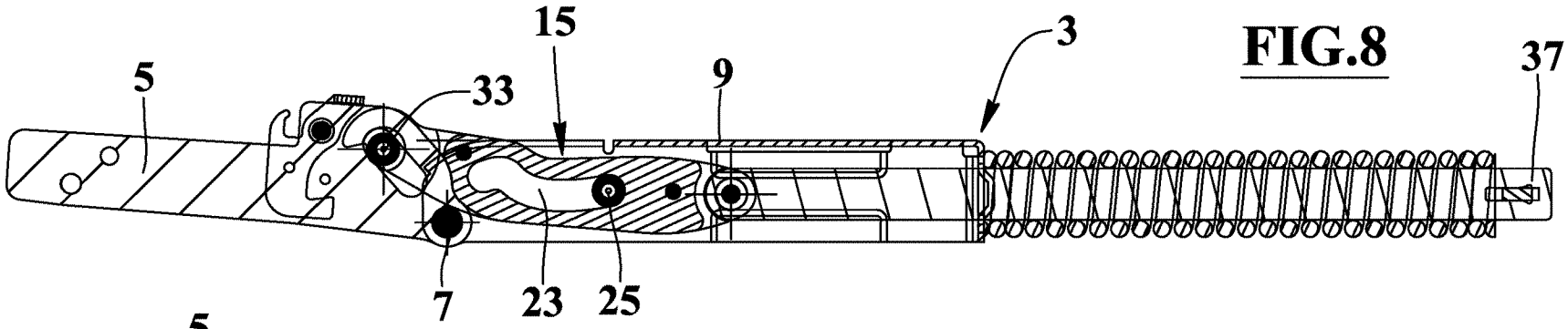
FIGS. 8-13 show the sectioned hinge of FIG. 7 in progressive conditions from extreme opening to closing, where in FIGS. 11 and 12 an element has been partially removed.
Figure 9:
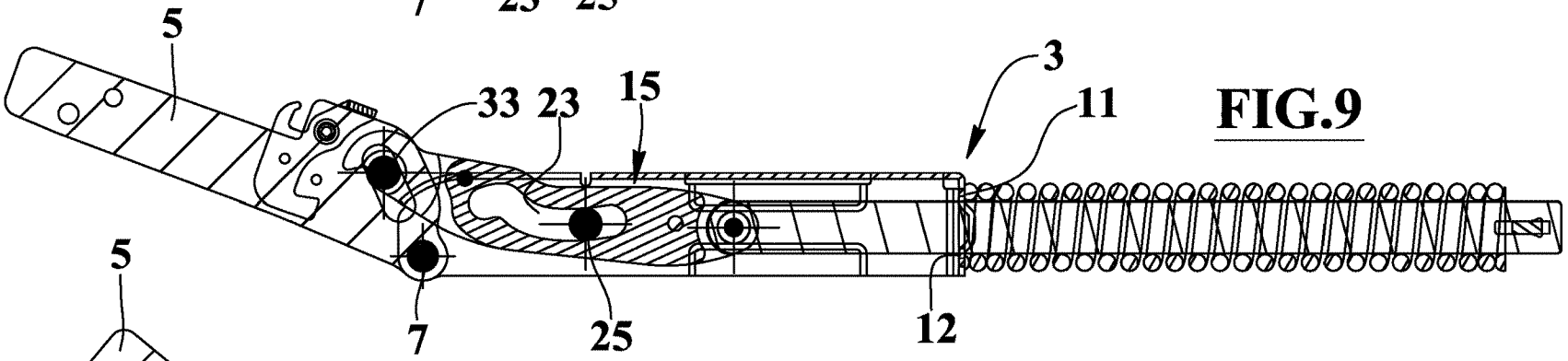

The elongated guide 17 can be constituted, for example, by a plastic element with one or two sliding rails and inserted in the body or the body 9 can be provided with two elongated guides of the slot type housed in parallel and opposite faces of the body 9 itself; in a preferable alternative and as dearly visible in FIG. 6, the body comprises two elongated guides each consisting of a profile with a "C" section obtained by bending a respective side wall of the body 9; a further alternative provides that each elongated guide is formed by two folded and parallel flaps obtained from two respective slots made parallel in said side wall of the body.

Preferably the constraint element 19 comprises an axis or shaft engaged in its seats obtained in the proximal end 36 of a tie-rod 37—described below—of the resilient element 13 and in the distal end 14 of the transmission member 15 for their mutual rotatable connection, such constraint element 19 also comprises two rolling elements fixed to respective ends of said axis or shaft, each of these rolling elements is assigned to roll along a respective elongated guide 17, housed in a respective side of the body 9, of the slot type or preferably of the "C" section profile type as shown in the figures.

One between the transmission member 15 and the box-like body 9 is provided with a first elongated slot 23 and the other 9, 15 is provided with a first mobile element 25 slidingly engaged in the first elongated slot 23.

Preferably, and as shown in the figures, the transmission member 15 is provided with the first elongated slot 23 passing through and crossed by the first mobile element 25, movable at least with respect to the first elongated slot, whose opposite ends are rigidly fixed to the respective parallel and opposite faces of the body.

One between said portion 8 of the second member 5 and proximal end 16 of the transmission member 15 carries a second slot 31 and the other 16, 8 carries a second mobile element 33, movable at least with respect to the second slot 31 in which it is slidingly engaged.

Preferably and as shown in the figures, the second slot 31 is housed in the portion 8 by means of the second member 5 and is slidingly engaged by the second mobile element 33 rigidly fixed to the proximal end 16 of the transmission member 15.

At least the shape of the first elongated slot 23, for example in an elongated and deformed "S" shape as shown in the figures, determines the inclination of the transmission member 15 with respect to the operative direction A and to the body 9, helping to determine the distance from the hinge pivot pin 7 of the elastic force application point to the second member 5 that is the distance between the hinge pivot pin and the point of contact between the second slot 31 and the second mobile element 33 fixed to the transmission member and/or helping to determine the direction of the elastic force transmitted to the second member 5, as a function of the angle formed between the first 3 and second 5 members in the opening and closing phases of the door or shutter.

The median geometric line of the first elongated slot 23, that is the curved line parallel to and interposed between the longitudinal edges of the first elongated slot, can be almost straight or curved with constant curvature or variable with curvature of constant sign or, preferably and as shown in the figures, the median geometric line of the first elongated slot 23 has two portions having curvatures of opposite sign and separated by a flex, that is by a point with zero curvature.

Preferably and as shown in the figures, the median geometric line of the second slot 31 is almost straight and inclined or, alternatively, it can be straight and radial with respect to the hinge pivot pin 7 or it can be curved.

Said tie-rod element 37 of the resilient element 13 has an elongated shape with the one proximal end 36 connected in a rotatable way, by means of the constraint element 19, to said distal end 14 of the transmission member 15 transmitting to the latter 15 the elastic force of the resilient element 13 itself which 13 further comprises a spring, for example helical axially engaged by a longitudinal portion of the transmission member 15 which therefore acts as a spring guide. Such spring, which preferably and as shown in the Figures is external to the body 9, is compressed between the connection or matching member 11 of the distal end 6 of the body 9 and a transverse retainer fixed to the distal end of the tie-rod element 37 which protrudes from the body 9 parallel to the operative direction A.

Said connection or matching member 11 consists of the distal face of the distal end wall of the body 9 which is perpendicular to the operative direction A and is connected to said side walls.

Said distal end wall of the connection or matching member 11 has a slot 12 opened on its free side assigned for insertion during assembly and for sliding in the operating condition of the tie-rod element 37. This configuration facilitates assembly of the device and at the same time it allows the tie-rod element 37 to translate parallel to itself and to the operative direction A ensuring a more silent operation and contributing to smooth rotation. Such slot 12, shown in FIGS. 14*a* and 14*b*, can be provided with a shaped bush in anti-friction material to further improve the sliding of the tie-rod element 37 or, for particular applications in which sliding friction does not represent a disadvantage, in friction material to brake such tie-rod element 37.

Furthermore, the distal face of the distal wall of the body 9 which constitutes the connection or matching member 11 can comprise a ridge or a projection or cavity assigned to engage with the proximal end of the spring to prevent unwanted disengagement of the spring from the connection or matching member 11 and the risk of the tie-rod element 37 coming out of the open slot 12.

The transmission member 15 consists of three at least partially flat shaped elements, each carrying a through opening corresponding to the first elongated slot 23.

When the three shaped elements are mutually fixed, for example by pins, rivets or the like, to form the transmission member 15, the three openings are aligned and side by side to form the first elongated slot 23.

The distal 14 and proximal 16 ends of two of these shaped elements fixed laterally as two outer shaped elements to the remaining shaped element placed centrally between them as a central or inner shaped element, protrude with respect to the shorter central or inner shaped element and carry the holes for the pins of the constraint element 19 and of the second mobile element 33 and distal and proximal concave seats assigned to house, at least in part, respectively the proximal end 36 of the tie-rod element 37 and the portion 8 of the second member 5.

Figure 14:
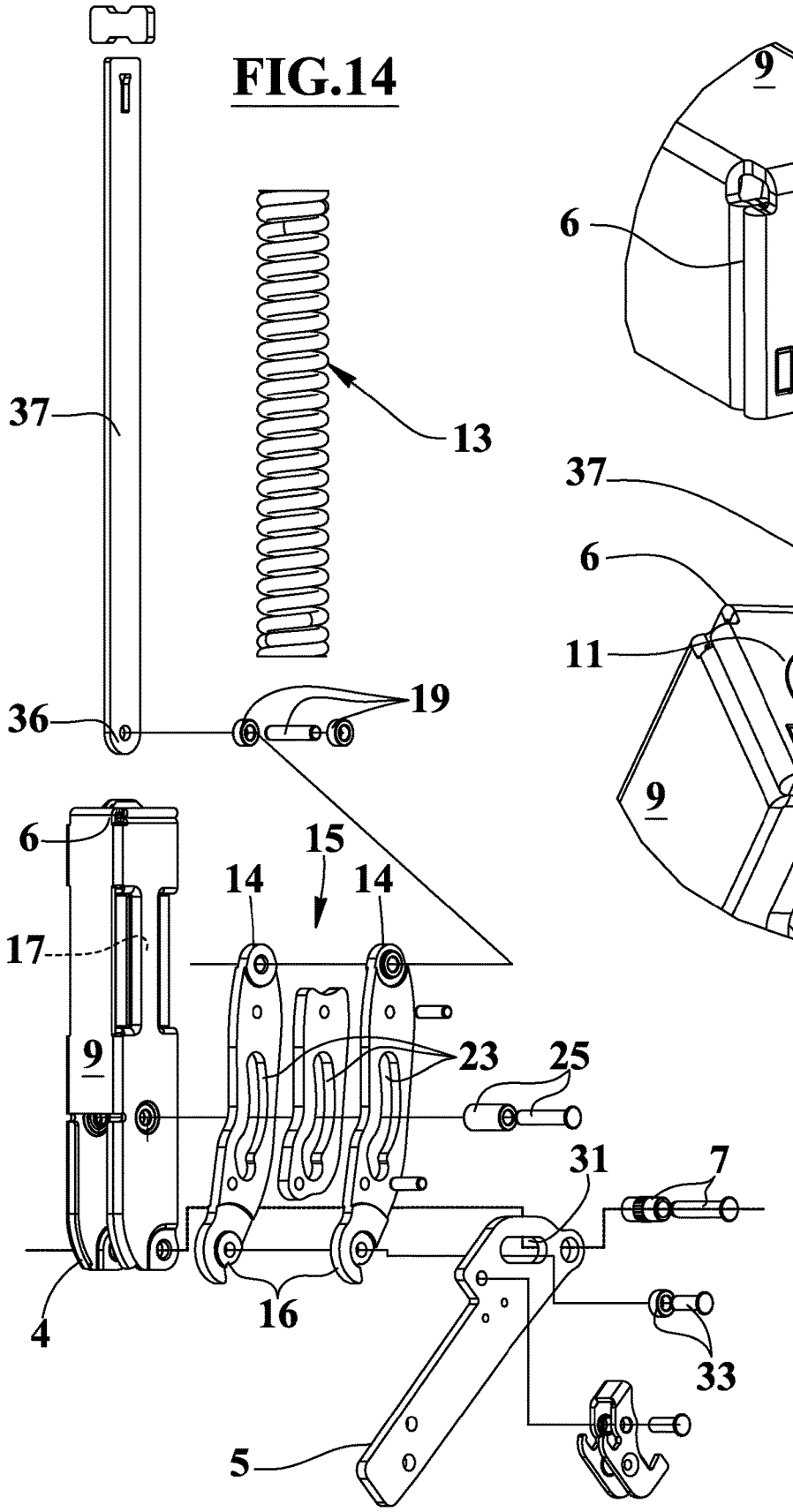
FIGS. 14, 14*a* and 14*b* show an exploded view of the device of FIG. 1 and partial and enlarged views of a single element thereof and associated with another element.
Figure 14A:
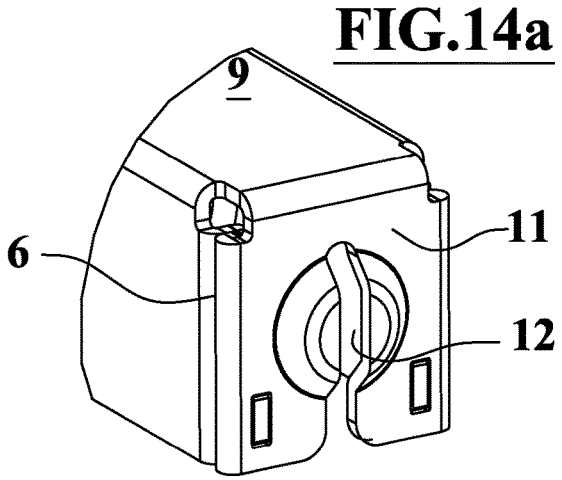
Figure 14B:
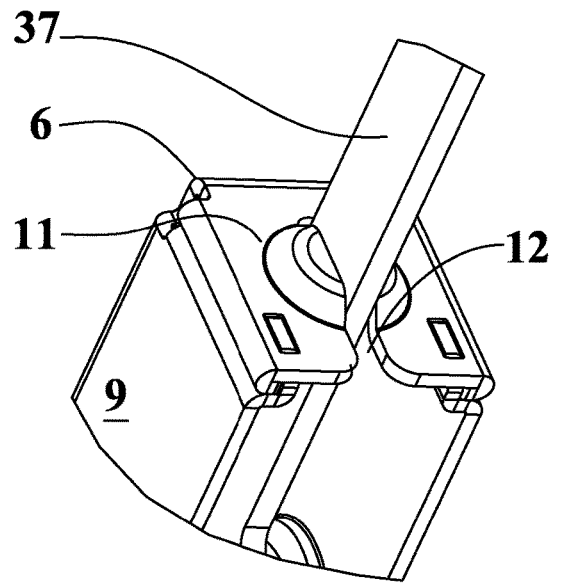
Figure 15:
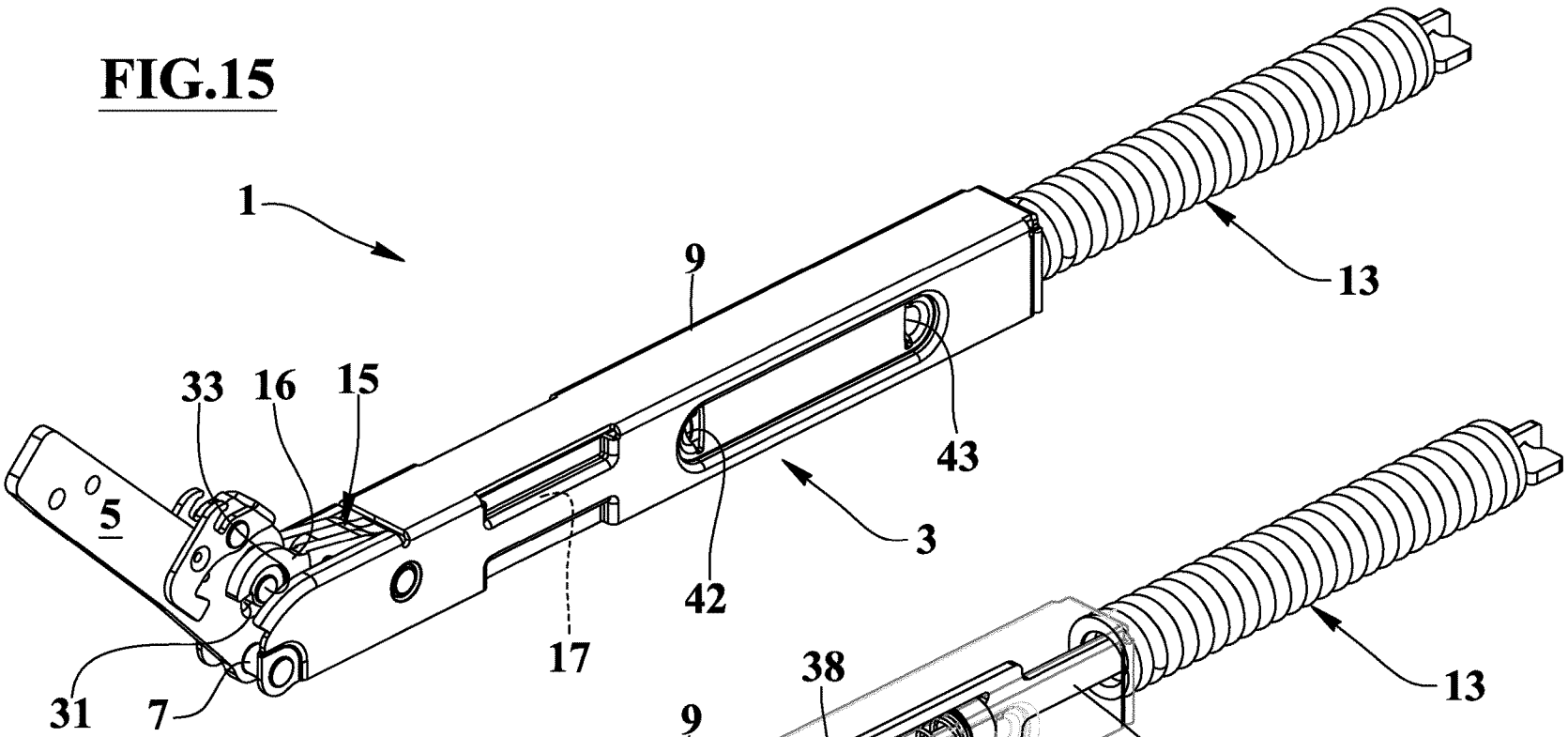
FIGS. 15 and 16 show axonometric views, from respective and opposite points of view, of a variant of the device of FIG. 1.
Figure 16:
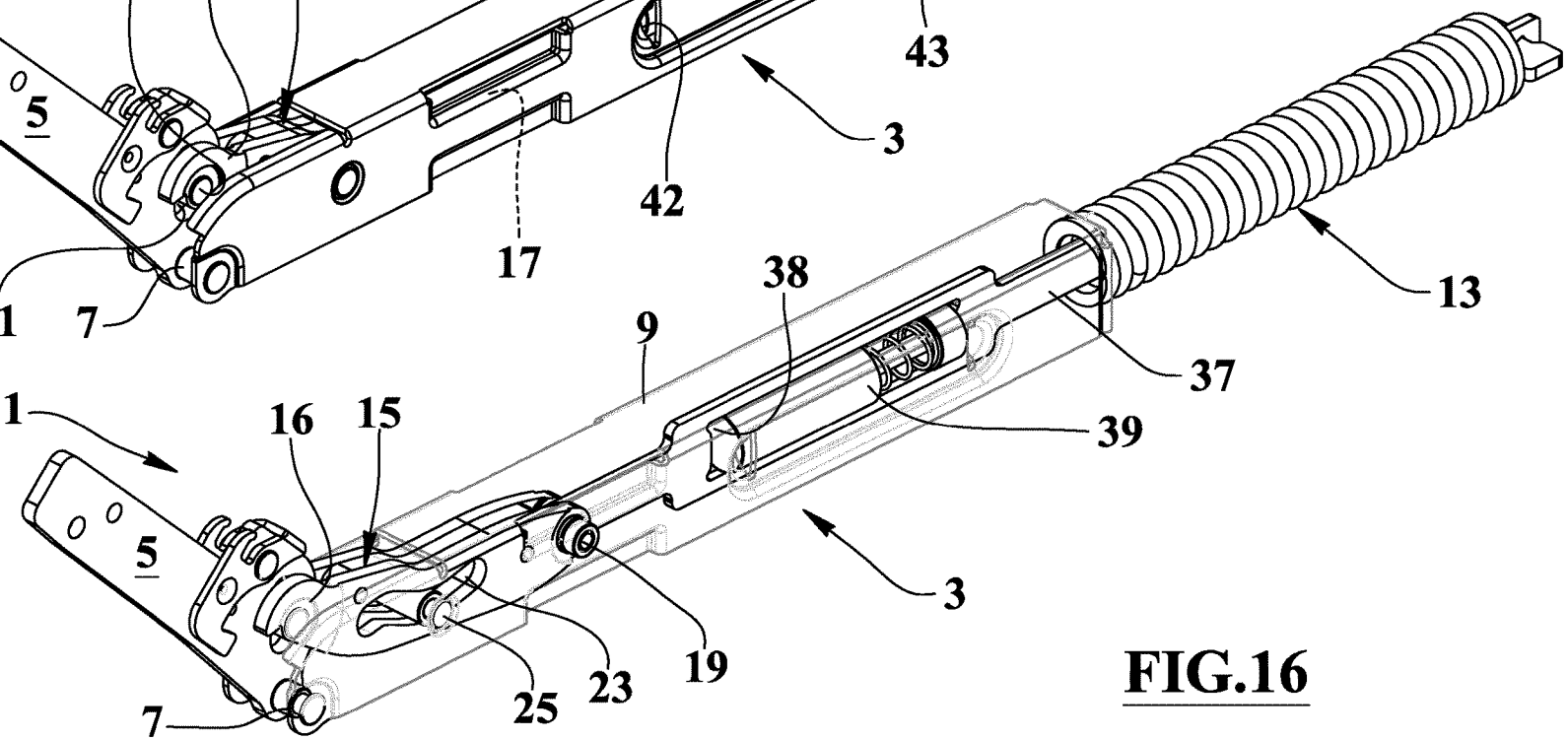
Figure 17:
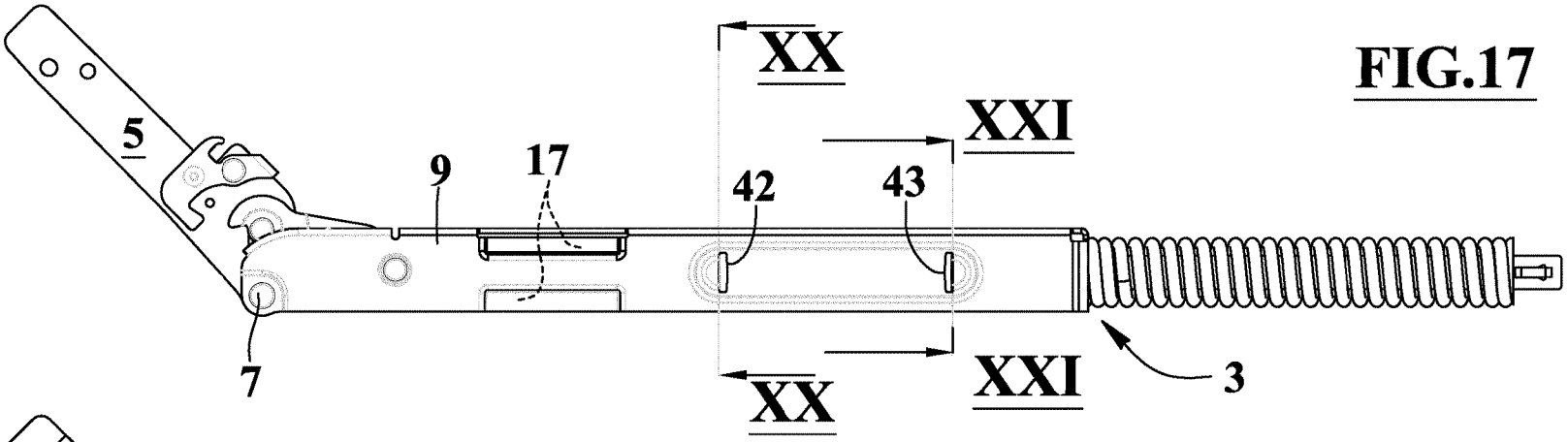
FIG. 17 shows a side view of the device of FIG. 15.
Figure 18:
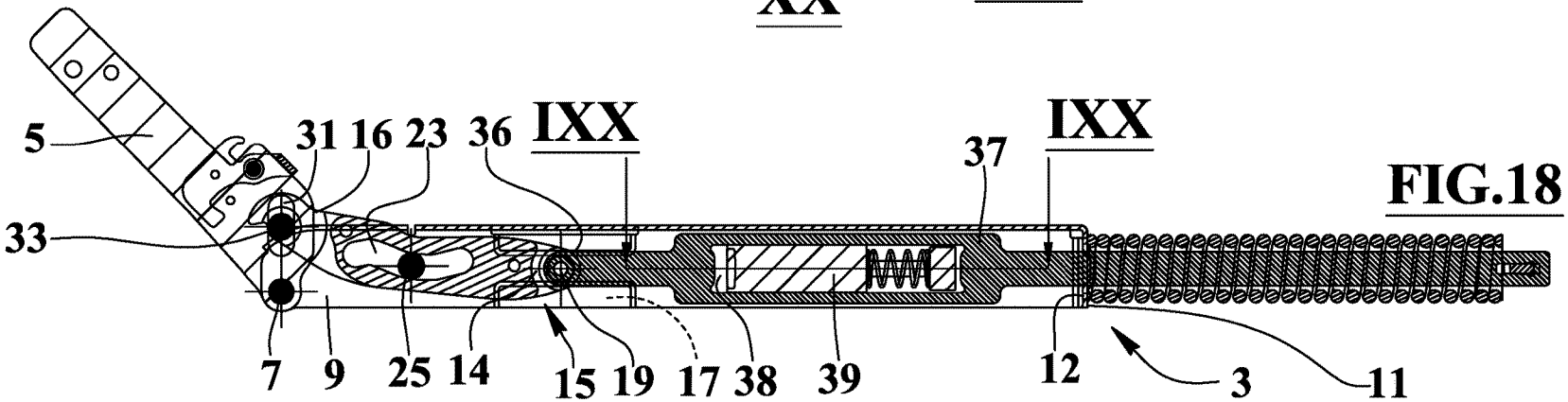
FIG. 18 shows a sectional view from a longitudinal median plane of the device of FIG. 17.

Each of the first 25 and second 33 mobile elements comprises a pin or, and as shown in FIG. 14, comprises a pin and a respective rotatable bushing.

The variant of the device 1, shown by way of example in FIGS. 15-32, differs from the previous embodiment mainly in the shape of the first elongated slot 23 and in the adoption of a dampener member 39.

This dampener member 39 is preferably of the linear type with an elastic return spring at its maximum length.

Figure 19:
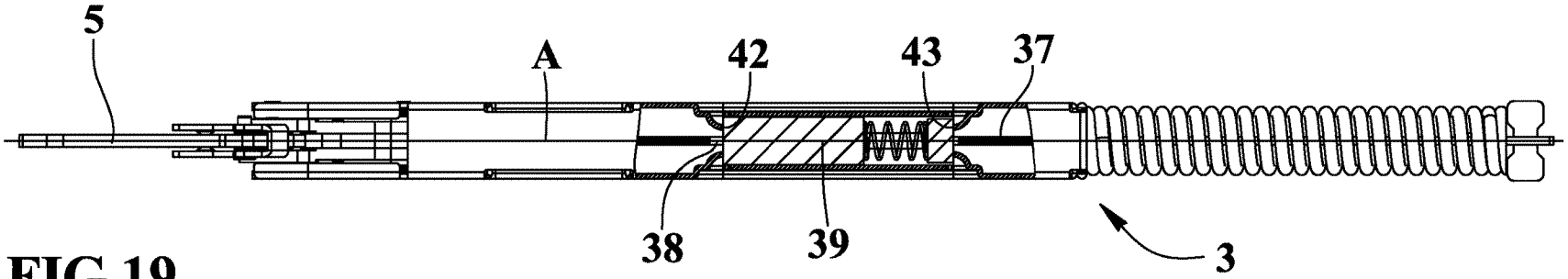
FIGS. 19-21 show sectional views according to the planes XIX-XIX of FIG. 18 and according to the planes XX-XX and XXI-XXI of FIG. 17, where
Figure 21:
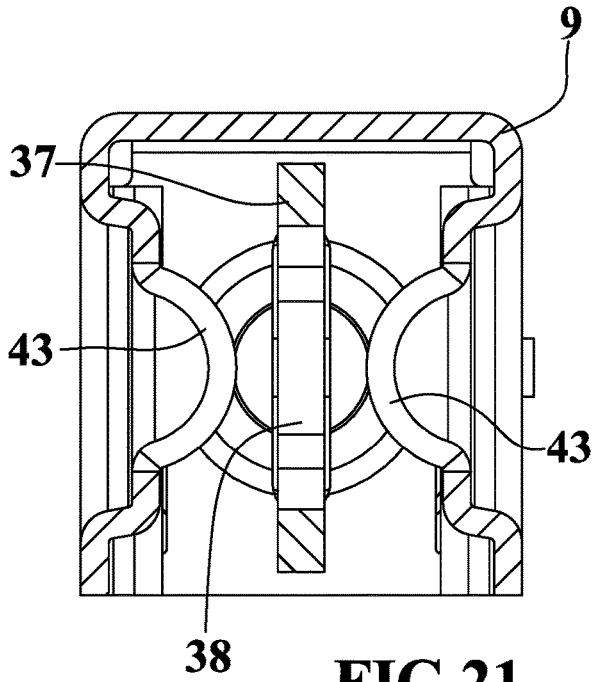
Figure 20:
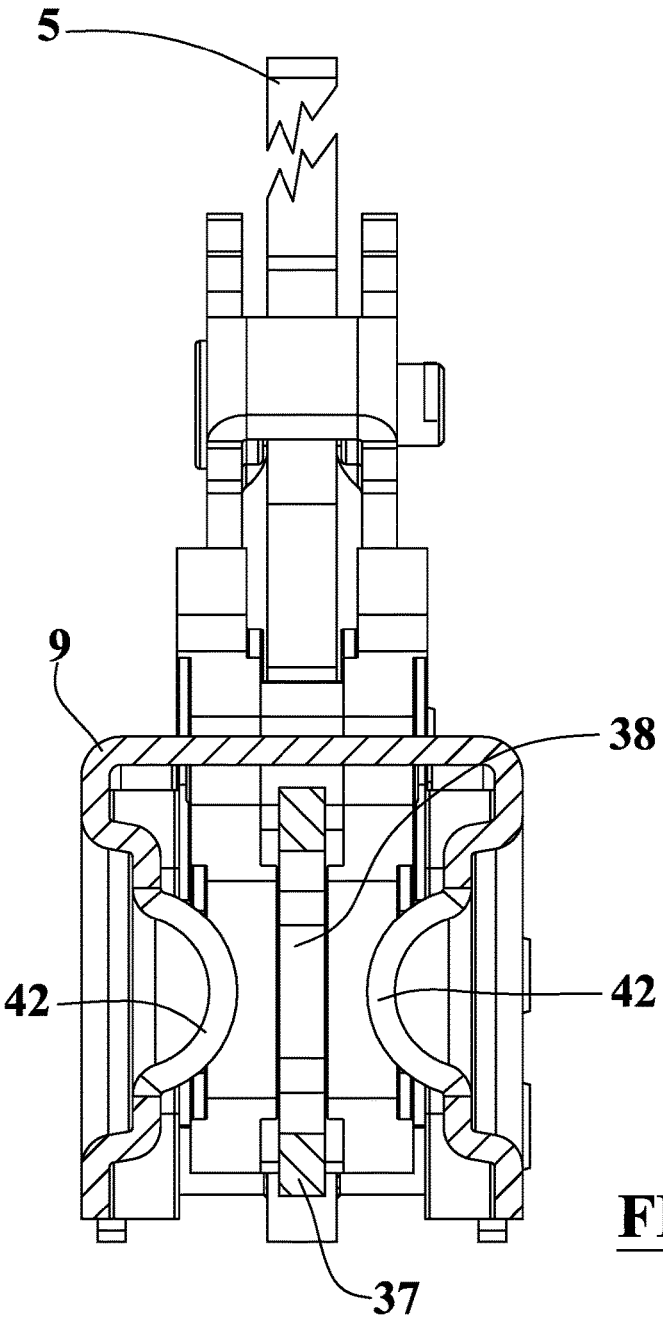
Figure 24:
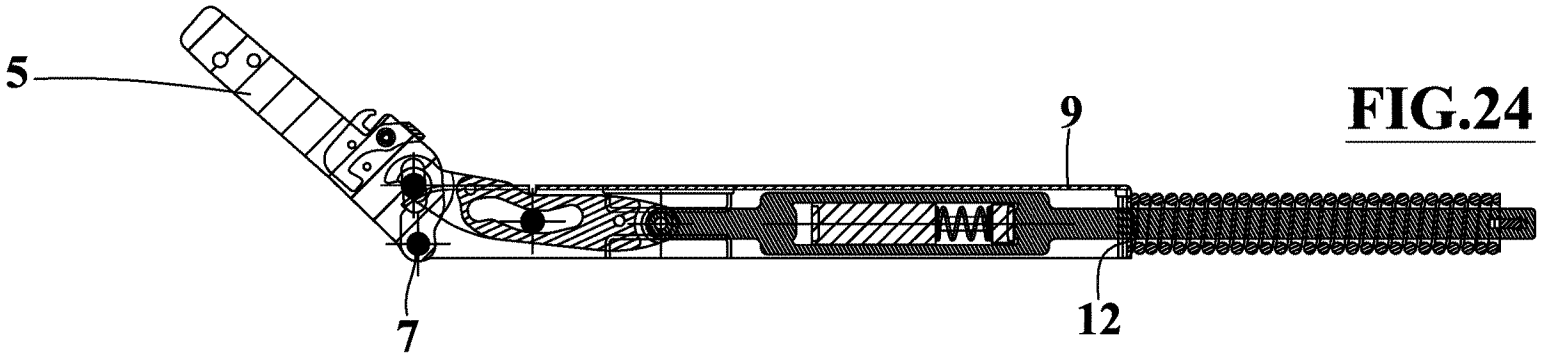
Figure 29:
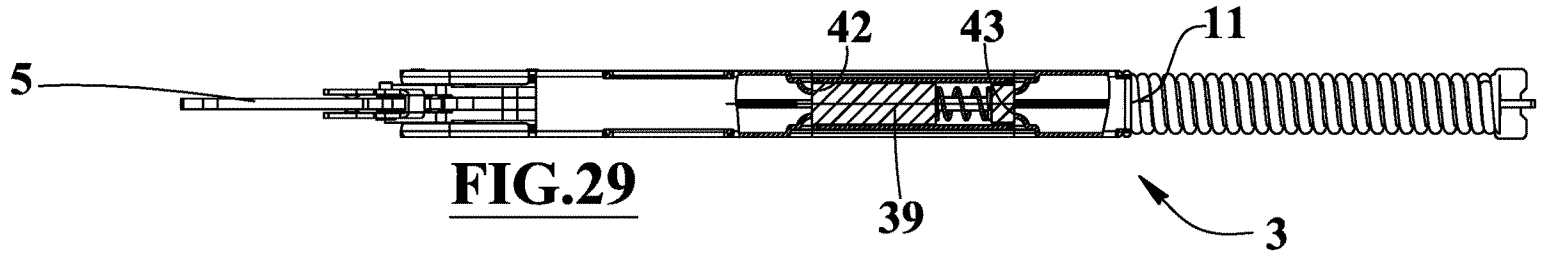
Figure 25:
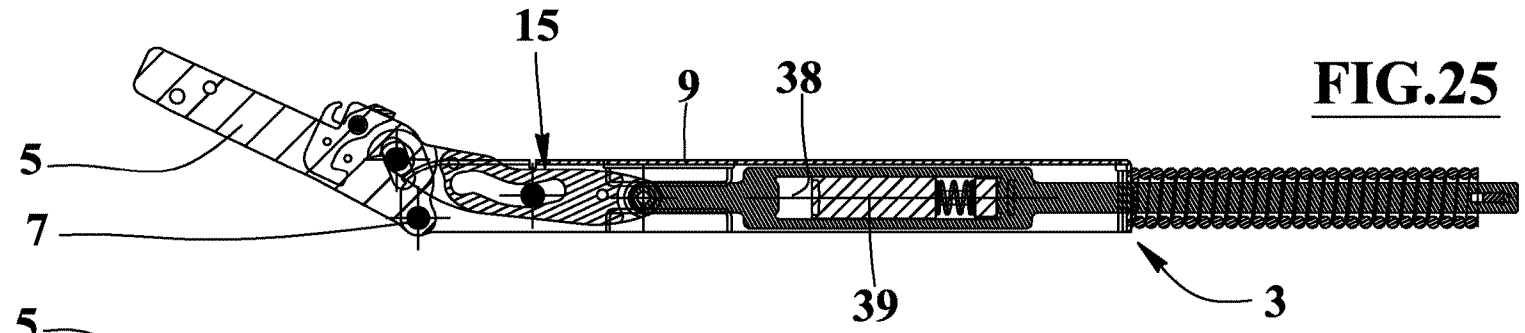
Figure 30:
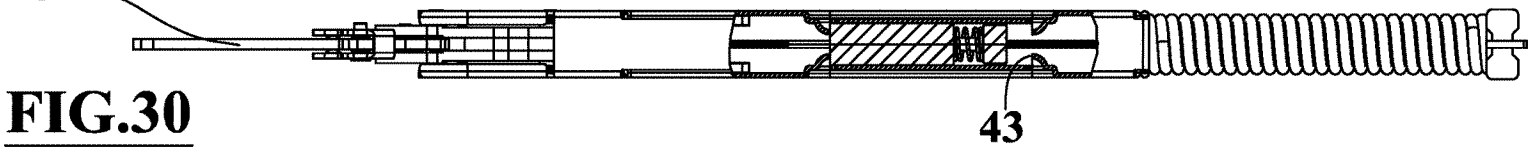
Figure 26:
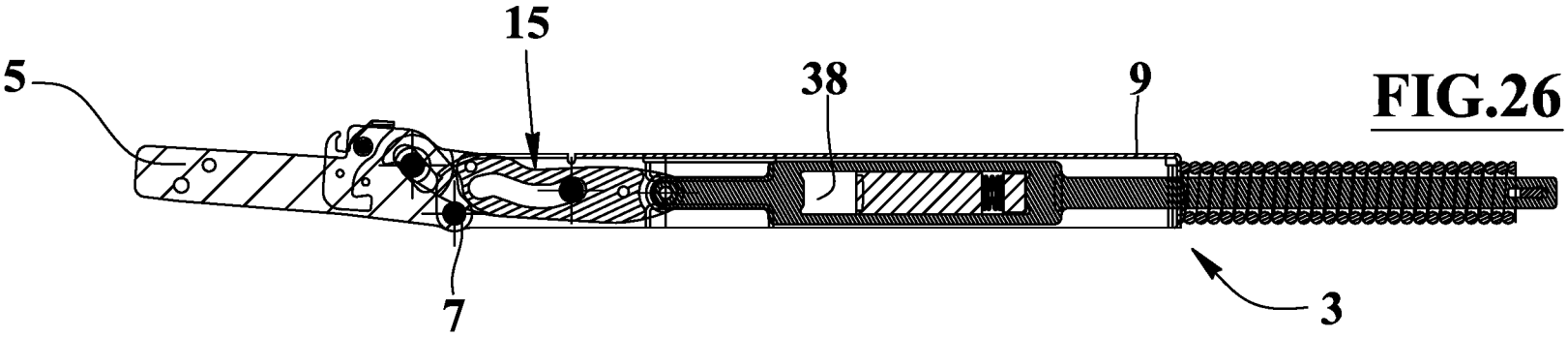
Figure 31:
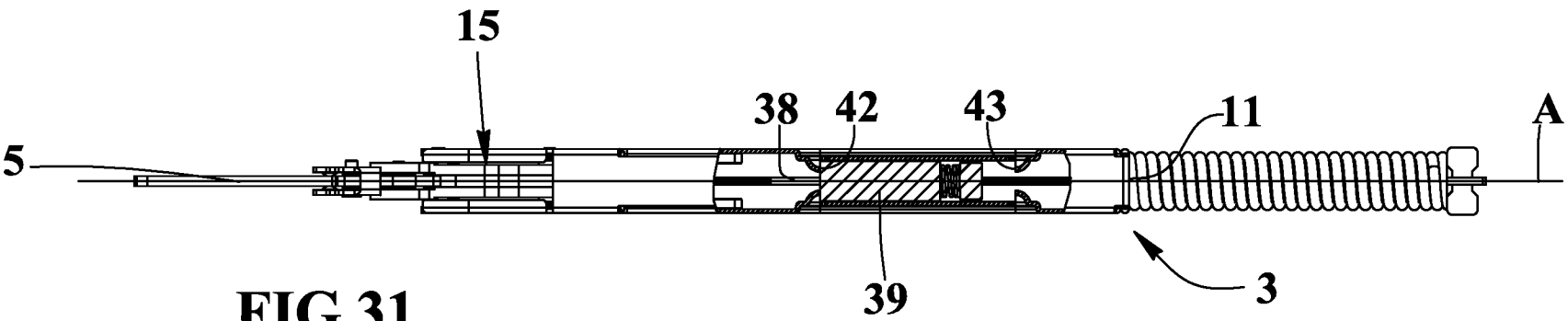
Figure 32:
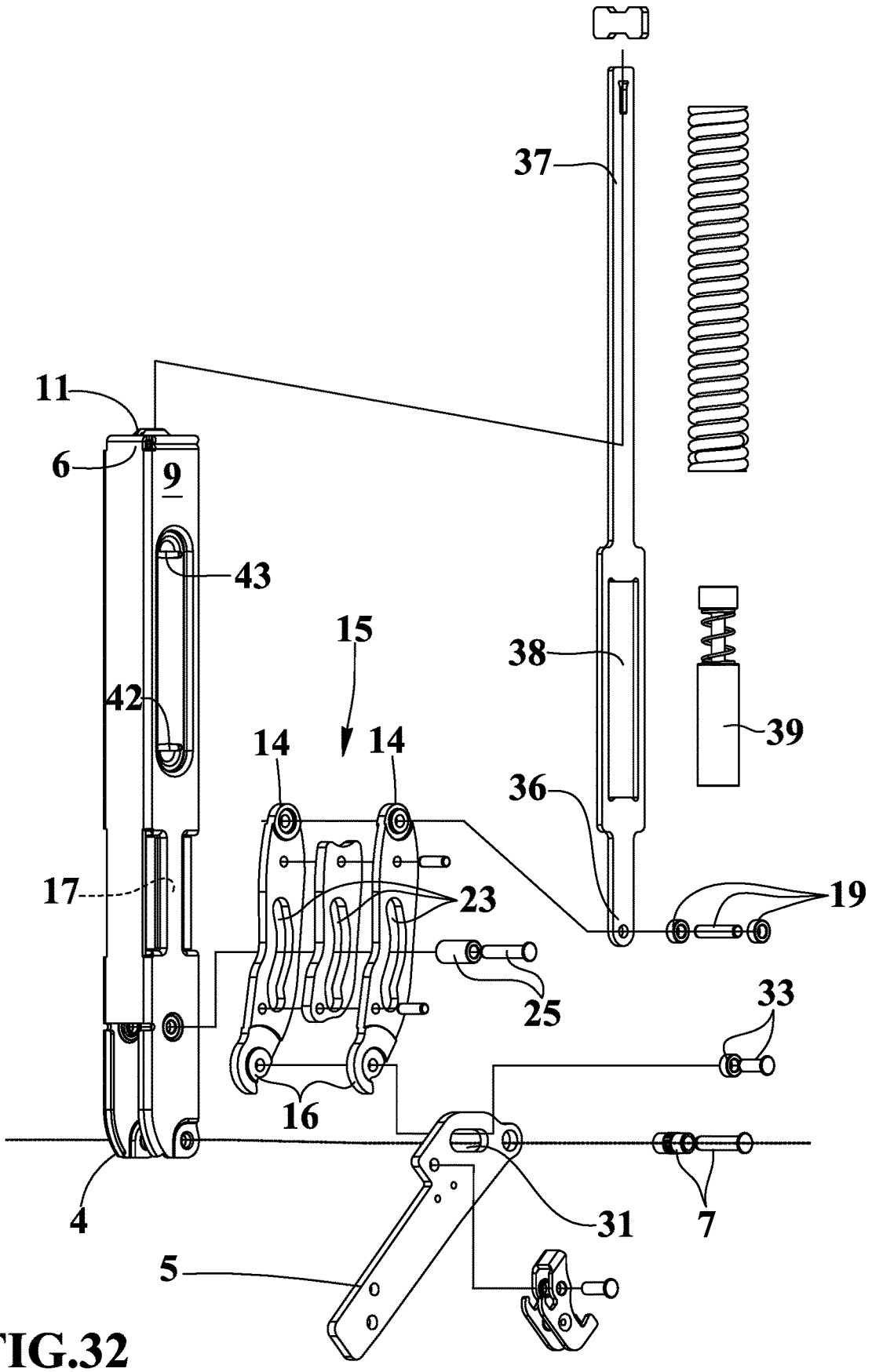
FIG. 32 shows an exploded view of the device of FIG. 15.

The internal portion of the body 9 of the tie-rod element 37 is provided with a window 38, for example of an approximately rectangular shape as shown in the figures in particular in FIG. 32, nearly parallel and equidistant from the two side walls and mutually parallel of the body 9 each of which carries a proximal stop 42 and a distal stop 43 clearly visible for example in FIGS. 19-21.

These stops can be obtained by means of processing, for example cutting or punching and deformation by means of punches of the two side walls of the body 9 in which they are recessed.

The extension along the operative direction A of such window 38 and the distance between said proximal 42 and distal 43 stops are approximately equal to or slightly greater than said maximum length of the dampener member 39 which is housed in the body 9 between said stops 42, 43 and housed in window 38.

In particular, said window extension and distance between the stops can be equal to said maximum length of the dampener or one of them can be the same and the other greater.

The mutual positions and respective dimensions of the window 38 and of the space between the stops 42, 43 determine the opening and; or closing angular sectors of the device in which the dampener member 39 is compressed between one of the transverse sides of the window and one of the stops and dampens the rotation speed of the device; therefore the dampening action of the rotation speed of the dampener member 39 can be programmed to be activated in almost all conditions, in the terminal opening and closing sections of the device or only in a terminal opening or closing section.

Figure 33:
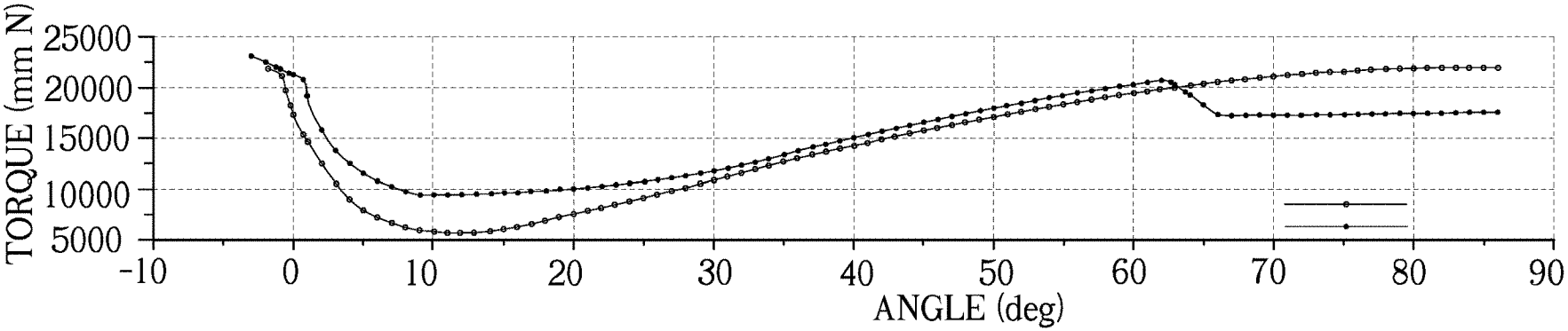
FIG. 33 shows a Cartesian representation of the trend of the closing torque as a function of the opening angle of the devices of FIG. 1 by means of a grey line with empty dots and of FIG. 15 by means of a black line with solid dots.
Figure 34:
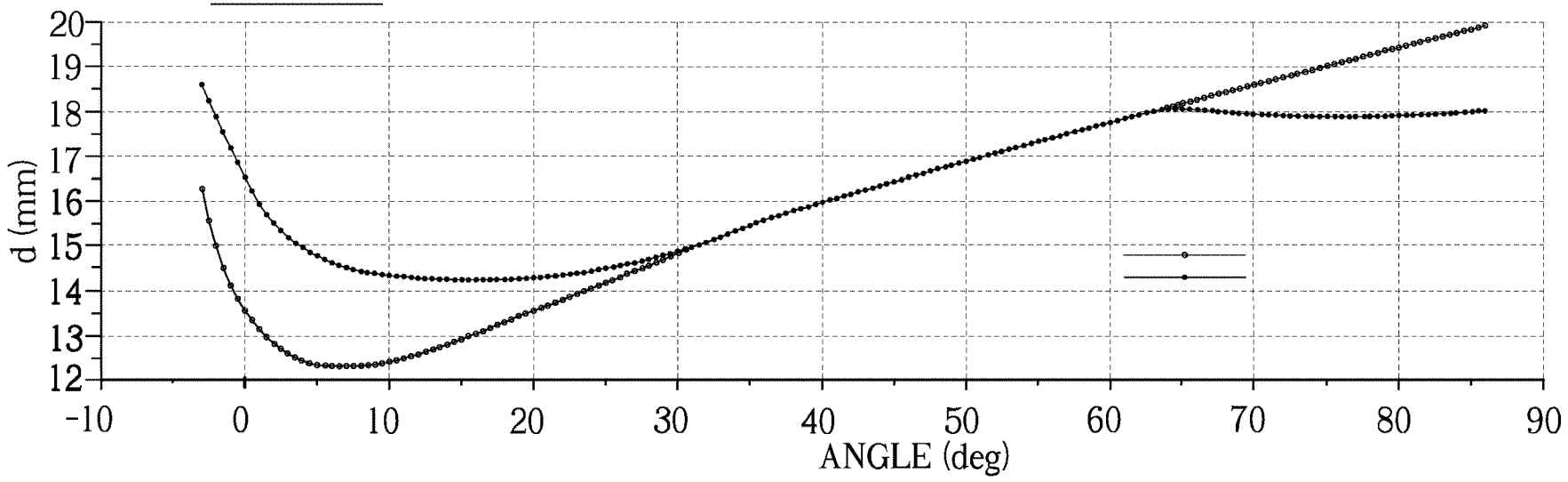
FIG. 34 shows a Cartesian representation of the trend of a parameter d (whose physical meaning of distance is represented in FIGS. 10, 22 and 23) as a function of the opening angle, in the devices of FIG. 1, by means of a grey line with empty dots, and of FIG. 15, by means of a black line with solid dots.

It should be noted that the shape of the first elongated slot 23 strongly affects the operating parameters of the device as shown in FIGS. 33 and 34 relating to the different shapes of the respective first elongated slots shown in FIGS. 1-14*b* of the first described shape of the device and in the FIGS. 15-32 of the variant.

Figure 10:
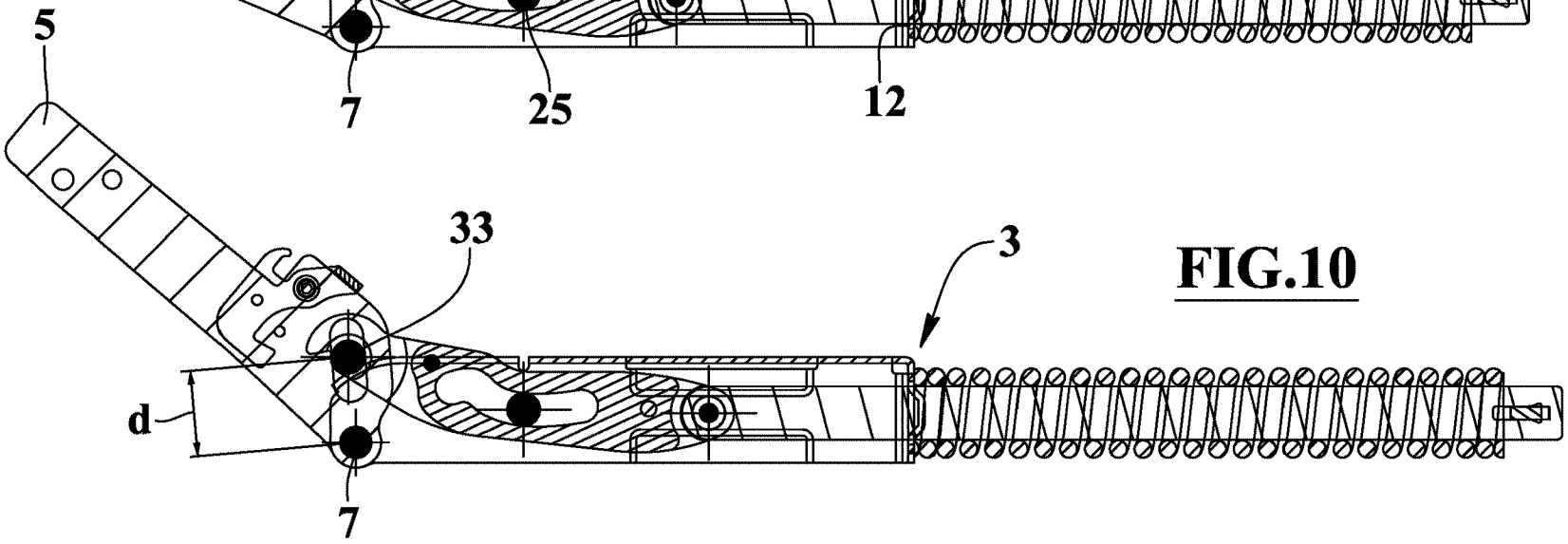
Figure 11:
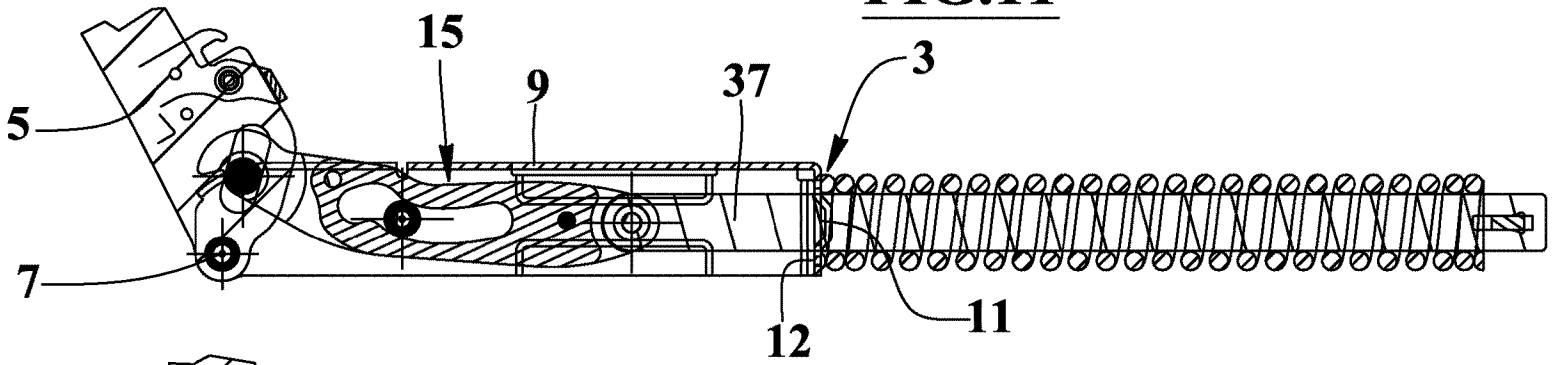
Figure 12:
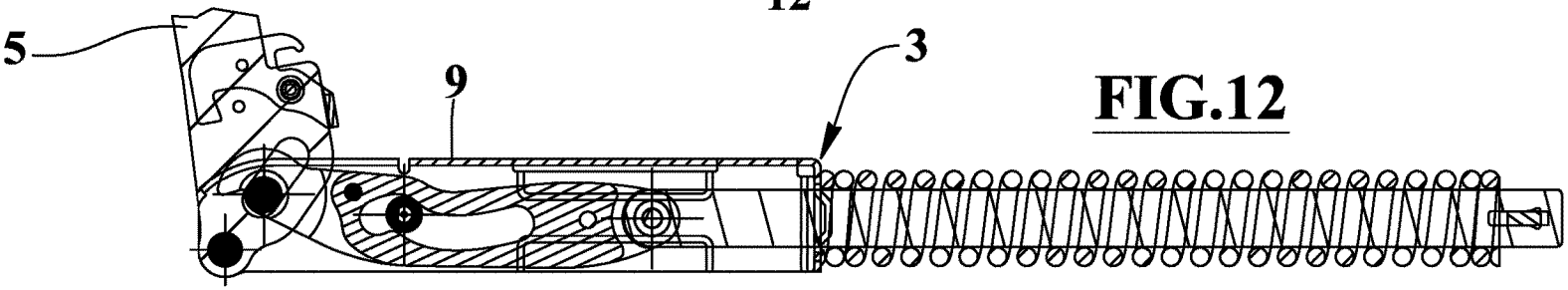
Figure 13:
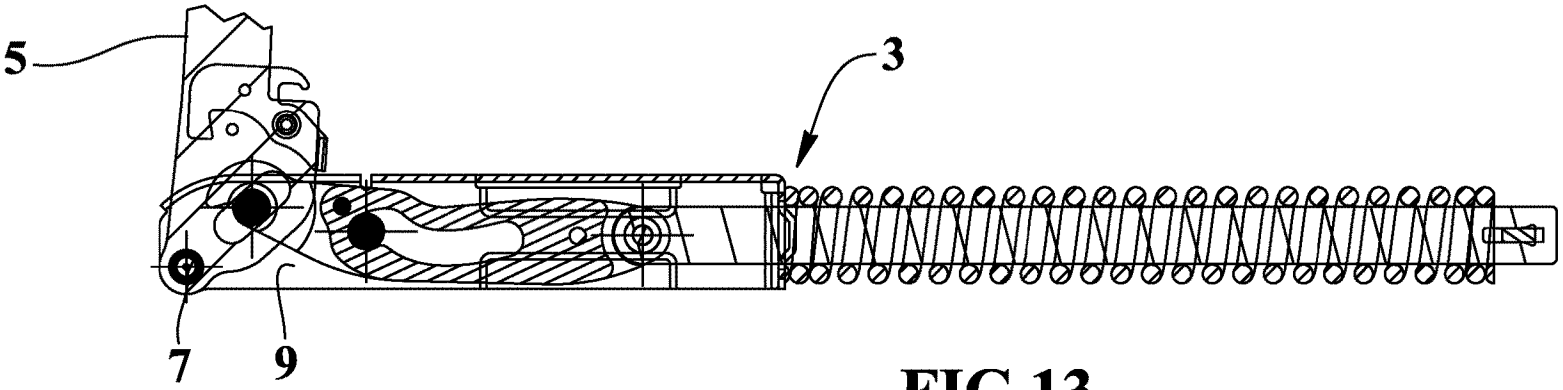

FIG. 34 shows how said different shapes of the first slots determine the different angular trends of the distances d between the hinge pivot pin 7 and the second mobile element 33 in the first embodiment—FIG. 10—and in the variant—FIGS. 22 and 23—in consequence of said differences between the respective first elongated slots.

In static or almost static conditions, the elastic torque applied to the second member depends not only on the distance d or arm, but also on the angle formed, with respect to the arm of the directrix of the force transmitted by the second mobile element 33 to the edge of the second slot 31 and depends on other factors such as the shortening of the spring.

FIG. 33 shows the differences in the angular trend of the closing torque in the two shapes of the device, again as a consequence of the respective and different shapes of the first elongated slots and with the same other characteristics of the two shapes of the device.

It is therefore possible to predetermine or program the torque trend 1*w* changing the shape of the first elongated slot and possibly also acting on the shape or inclination of the second slot.

Determining the shape of the first elongated slot and possibly the shape and/or inclination of the second slot allows to modulate and/or adjust the effect of the dampener member 39 on the dynamic behavior of the second member 5.

The invention claimed is:

1. Hinge device (1) comprising a first member (3) and a second member (5) connected for mutual swiveling by means of a hinge pivot pin (7), one of said first member (3) and said second member (5) is assigned to be fixed to a structure or frame of an appliance and the other to be fixed to a door or shutter for rotation of the door or shutter closed and totally open conditions of the appliance; the first member (3) comprises a box-shaped body (9) comprising opposite proximal and distal ends (4, 6) including respectively a seat for the hinge pivot pin (7) and a connection or matching member (11) for a resilient element (13) for providing an elastic force connected to a distal end (14) of a transmission member (15) at least partially contained in the box-shaped body (9) and mobile with respect to the box-shaped body (9) to transmit to said transmission member (15) the elastic force of the resilient element (13) acting in a respective operative direction (A) and in an opposite direction from the hinge pivot pin (7) toward the distal end (14), wherein a portion (8) of the second member (5) placed at a predetermined distance from a hinge pivot pin (7) is connected to a proximal end (16), opposite the resilient element (13), of said transmission member (15); said box-shaped body (9) is equipped with at least one elongated guide (17) having a geometric axis that is parallel to the operative direction (A) and along which at least one constraint element (19) fixed to said distal end (14) of the transmission member (15) slides; said transmission member (15) equipped with a first elongated slot (23) and the body (9) equipped with a first mobile element (25) slidingly engaged in the first elongated slot (23); said portion (8) of the second member (5) carries a second slot (31) and the proximal end (16) of the transmission member (15) carries a second mobile element (33) slidingly engaged in the second slot (31), at least a shape of the first elongated slot (23) contributes to determining a distance from the hinge pivot pin (7) of a point of application of the elastic force, or a direction of the elastic force transmitted to the second member (5), or both, and as a function of an angle formed between the first member (3) and the second member (5) in the opening and closing phases of said door or shutter; wherein the resilient element (13) comprises an elongated tie-rod element (37) having a proximal end (36) rotatably connected to said distal end (14) of the transmission member (15) to transmit to the transmission member (15) the elastic force of the resilient element (13) and wherein the transmission member (15) consists of three shaped elements at least partially flat, each having a through opening corresponding to the first elongated slot (23), the distal end (14) and the proximal end (16) of two of the shaped elements, fixed laterally to a remaining shaped element centrally between the two of the shaped elements, have seats respectively for the constraint element (19) and for the second mobile element (33), the remaining shaped element fixed centrally between the two of the shaped elements being a central or inner shaped element shorter than the two of the shaped elements being outer shaped elements providing distal and proximal seats respectively for the proximal end (36) of a tie-rod element (37) and for the portion (8) of the second member (5); the first mobile element (25) and the second mobile element (33) each comprising a pin or a pin and a respective rotating bush.

2. The hinge device according to claim 1, wherein the first elongated slot (23) and the first mobile element (25) are respectively positioned in the transmission member (15) and fixed to the box-shaped body (9) and wherein the second slot (31) and the second mobile element (33) are respectively positioned in the portion (8) of the second member (5) and fixed to the proximal end (16) of the transmission member (15); where a median geometric line of the first elongated slot (23) is either between straight or curved with constant or variable curvature of constant sign or with at least two sections having opposite sign curvatures and separated by a flex and where a median geometric line of the second slot (31) is one between straight and inclined or straight and radial with respect to the hinge pin (7) or curved.

3. The hinge device according to claim 1, wherein the proximal end (36) of the elongated tie-rod element (37) of the resilient element (13) is rotatably connected to said distal end (14) of the transmission member (15) by means of the constraint element (19) for transmitting the elastic force of the resilient element (13) to the transmission member (15).

4. The hinge device according to claim 1, wherein the constraint element (19) comprises an axis or shaft engaged in seats formed in the proximal end (36) of the tie-rod (37) and in the distal end (14) of the transmission member (15) for mutual connection, wherein the constraint element (19) further comprises two rolling elements fixed to respective ends of said axis or shaft, each of these rolling elements is assigned to roll along a respective elongated guide (17) formed in a respective side of the body (9).

5. The hinge device according to claim 4, wherein each elongated guide (17) consists of a "C-shaped" section profile obtained by bending a side wall of the body (9) or is obtained from two folded and parallel flaps formed from two respective slots made parallel in said wall.

6. The hinge device according to claim 3, wherein the resilient element (13) comprises a compressed spring between the connection or matching member (11) of the distal end (6) of the body (9) and a retainer fixed to the distal end of the tie-rod element (37) parallel to the operative direction (A) and protruding from the body (9).

7. The hinge device according to claim 6, wherein the connection or matching member (11) comprises a distal face of a distal wall of the body (9) that is perpendicular to the operative direction (A) and is connected to two lateral and mutually parallel walls of the body (9) and having at least one free side.

8. The hinge device according to claim 7, wherein said connection or matching member (11) has an open slot (12) in said at least one free side assigned for insertion of the tie-rod element (37) during assembly, the tie-rod element for sliding in the open slot (12) in an operating condition of the tie-rod element (37).

9. The hinge device according to claim 8, wherein the distal face of the distal wall of the body (9) that constitutes the connection or matching member (11) comprises a ridge or protrusion or cavity assigned to engage with the proximal end of the spring to prevent disengagement of the spring from the connection or matching member (11) and to prevent the tie-rod element (37) exiting from the open slot (12).

10. The hinge device according to claim 7, further comprising a dampener member (39) of a linear type with elastic return spring at a maximum length of the dampening member and wherein the tie-rod element (37) is equipped with a window (38) and is parallel and equidistant from said two lateral and mutually parallel walls of the body (9) each having a proximal stop (42) and a distal stop (43) where a distance between the proximal (42) stop and the distal stop (43) is equal to or greater than said maximum length of the dampener member (39) housed in the body (9) between said stops (42, 43) and constrained in the window (38).

11. The hinge device according to claim 10, wherein mutual positions and respective dimensions of the window (38) and of a space between the stops (42, 43) determine angular sectors of opening, closing, or opening and closing of the hinge device in which the dampener member (39) dampens rotation speed of the hinge device.

* * * * *